United States Patent [19]

Fields

[11] 4,097,098

[45] Jun. 27, 1978

[54] BUMPER LOCK FOR DISHWASHING MACHINE RACK SUPPORT

[75] Inventor: Virgil L. Fields, Troy, Ohio

[73] Assignee: Hobart Corporation, Troy, Ohio

[21] Appl. No.: 818,051

[22] Filed: Jul. 22, 1977

[51] Int. Cl.[2] ..... A47B 57/04; A47B 88/04

[52] U.S. Cl. ..... 312/311; 312/339; 312/348

[58] Field of Search ..... 312/306, 311, 312, 339, 312/341, 348, 351; 308/3.6, 3.8

[56] References Cited

U.S. PATENT DOCUMENTS

| | | | |
|---|---|---|---|
| 3,269,548 | 8/1966 | Geiger et al. | 312/306 |
| 3,472,573 | 10/1969 | Geiger | 312/339 |
| 3,736,037 | 5/1973 | Doepke | 312/311 |

*Primary Examiner*—Casmir A. Nunberg

*Attorney, Agent, or Firm*—Biebel, French & Nauman

[57] ABSTRACT

A dishwashing machine has a tank defining a cleansing chamber, a rack within the chamber having a bottom and parallel sides and elongated tracks extend between the sides of the rack and the chamber side walls. Each track includes longitudinally extending guideways, one on each side of the track. Rollers mounted on the tank side walls are received within one guideway of each track, and rollers mounted on each side of said rack are received within the other guideway of the corresponding track. A bumper member mounted on each end of each said track has a retaining tab formed as an integral extension to the bumper member, and a lock part on the tab is engaged through a hole in the track. A retaining pin extends through the ends of the track and through the bumper member. The pin has a head preventing the pin from passing completely through the track and the tab extends over the head of the pin.

3 Claims, 3 Drawing Figures

BUMPER LOCK FOR DISHWASHING MACHINE RACK SUPPORT

BACKGROUND OF THE INVENTION

This invention involves the support of a rack within a dishwashing machine, especially the support of an upper rack within a front loading dishwashing machine. U.S. Pat. No. 3,472,573 issued Oct. 14, 1969, to Hobart Corporation, assignee of this invention, discloses and shows in FIG. 5 a form of bumper which contains rollers on the tank side wall and on the rack within the guideways of the track. Under some circumstances the pin 74, which holds the bumper to the end of the track, may work loose. Then, if the rack is pulled or pushed against the bumper, this will dislodge the bumper and allow the rack to run out of the track, or cause the track to disengage from the chamber-mounted rollers.

SUMMARY OF THE INVENTION

The present invention thus is directed to a novel form of such a bumper, including an integral lock tab or keeper which retains the bumper to the track. In the preferred embodiment the lock tab is hinged to an end of the bumper and includes a compressible lock part that is snapped into a hole near the end of the track. The head of the retaining pin is located under the tab. Thus with an easy assembly operation the bumper is pinned to the end of the track (as before) and the bumper is locked into position, capturing the head of the pin.

Other advantages and features provided by the rack support of the invention will be apparent from the following description, the drawing and the appended claims.

DESCRIPTION OF THE PREFERRED EMBODIMENT

Figure 1:
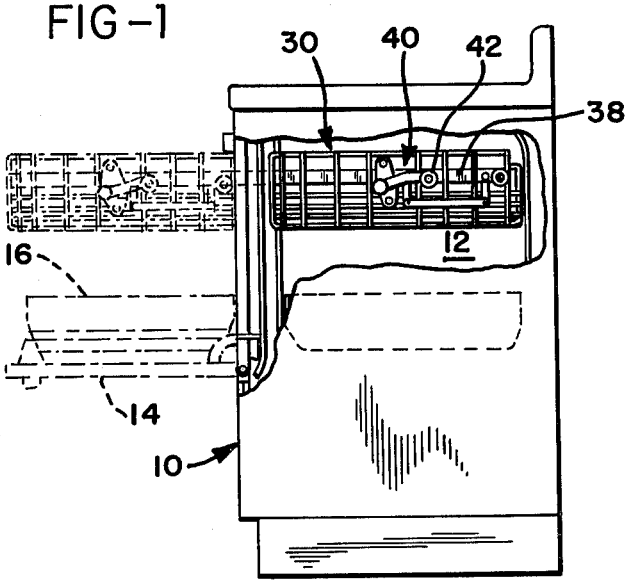
FIG. 1 is a side view of a front loading dishwashing machine with a portion of the side wall broken away to show the loading and washing positions of the upper rack.
Figure 2:
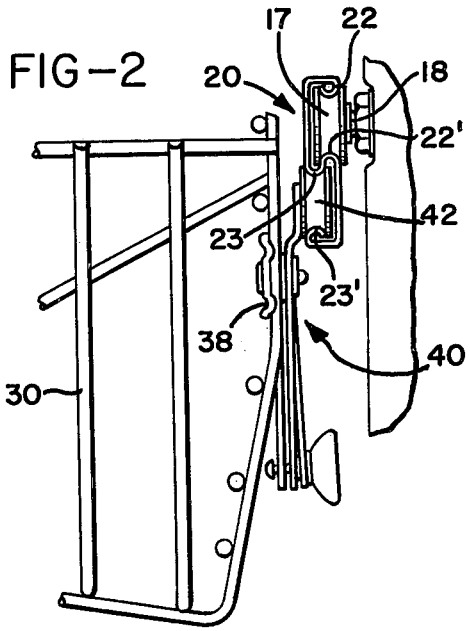
FIG. 2 is a fragmentary elevational end view of the rack support.

Referring to the drawing which illustrates a preferred embodiment of the invention, FIG. 1 shows a front loading dishwashing machine which includes a tank 10 defining a cleansing chamber 12 having a front opening and a door 14 pivotally mounted at the bottom of the opening and movable from a vertical closed position to a horizontally open position as illustrated by the dotted lines in FIG. 1. A lower rack 16 is supported within the chamber 12 by suitable tracks (not shown) and is adapted to be rolled out into the door 14 for loading and unloading when the door is open.

In the upper portion of the tank 10, a pair of horizontally spaced rollers 17 are mounted on each side wall of the tank by threaded stud shafts 18 which extend through corresponding holes formed within the tank walls to receive nuts (not shown). At each side, an elongated track 20, preferably formed from stainless steel sheet and generally S-shaped in cross-sectional configuration, includes longitudinally extending bead portions 22 and 23 forming an upper guideway for receiving the corresponding rollers 17 in interfitting relationship. Each track 20 also includes corresponding bead portions 22' and 23' which form a lower guideway.

An upper rack 30 is positioned within the chamber 12, supported on each side by the tracks 20 for horizontal movement between a position within the chamber 12 and a position above the open door 14, as shown in FIG. 1. Reference is made to U.S. Pat. No. 3,269,548 for a detailed description of a typical upper rack.

An elongated strap or plate 38 is mounted on each side portion 35 of the upper rack 30. These plates may directly mount rollers in the case of a non-adjustable rack, or each plate 38 may be connected to a corresponding track 20 by a lever mechanism 40, which forms a height adjusting mechanism as described in U.S. Pat. No. 3,472,573. The mechanisms include rollers 42 which fit into the lower track guideways.

Figure 3:
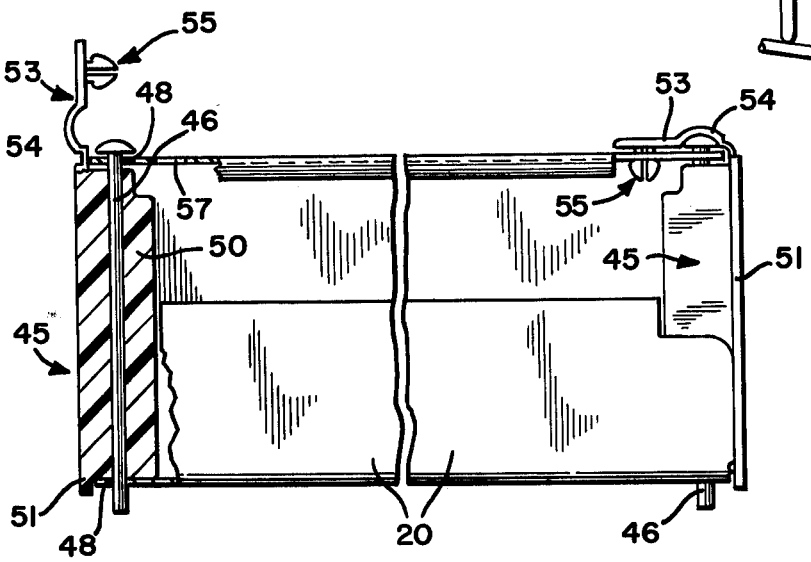
FIG. 3 is a side elevational view of the track with parts broken away to show the bumper details.

Referring to FIG. 3, a bumper member 45 is mounted on each end of each track 20, and is retained by a pin 46 extending through aligned holes 48 formed through the bumper member and the upper and lower track ends. The bumper members serve to prevent the rollers 17 and 42 from leaving the ends of the tracks 20 when the rack 30 is extended out over the door 14, and to prevent the rear ends of the tracks 20 from engaging the rear wall of the tank 10 when the rack is moved into the chamber.

Each bumper member 45 is preferably formed of a molded material such as polypropylene or the like. It includes a body 50 dimensioned to fit into the end of the track, and a flange 52 to engage the outer end of the track and position the bumper. Extending from one end of the bumper is an integrally hinged retaining tab 53, having an arcuate section 54 to fit over the head of pin 46, and a split lock part or insert 55. The insert fits tightly into an aperture 57 in the track, and spreads against the edge of the aperture to hold the lock tab in place.

Thus, the bumper includes a means to lock its retaining pin 46 securely in place. This same means also functions to hold the bumper securely to the track. For best security, the pins 46 hold the bumpers against the force of the rollers striking the bumpers. However, it would be possible to use locking tabs at both ends of the bumper, and eliminate the pins, in constructions where the forces were less, or the bumpers and tabs were formed of a more expensive and stronger material.

While the form of apparatus herein described constitutes a preferred embodiment of this invention, it is to be understood that the invention is not limited to this precise form of apparatus, and that changes may be made therein without departing from the scope of the invention.

What is claimed is:

1. In an improved track system for a dishwashing machine having a tank defining a cleansing chamber, a rack within said chamber having a bottom portion and parallel spaced side portions, elongated tracks extending adjacent said side portions of said rack, each said track including longitudinally extending guideways one on each side of the track, roller means mounted on said tank and received within one of said guideways of each said track and roller means mounted on each said side portion of said rack and received within the other said guideway of the corresponding said track, and a bumper member mounted on each end of each said track, the improvement comprising a retaining tab formed as an integral extension to said bumper member, and a lock part on said tab engaged through a hole in said track.

2. A rack system as defined in claim 1, including a retaining pin extending through the ends of said track and through said bumper member, said pin having a head preventing the pin from passing completely through the track, and said tab extending over said head of said pin.

3. In a dishwashing machine having a cleansing chamber with side walls and a front opening door, a rack within said chamber having a side portions adjacent the side walls of said chamber, elongated tracks extending between said side portions of said rack and said side walls, each said track including longitudinally extending guideways one on each side of the track, roller means mounted on said side walls and received within one of said guideways of each track and roller means mounted on each said side portion of said rack and received within the other said guideway of the corresponding said track; an improved bumper member mounted on at least one end of each said track and comprising a retaining tab formed as an integral extension to said bumper member, and a lock part on said tab engaged through a hole in said track.

* * * * *